US008262307B1

(12) United States Patent
Cross

(10) Patent No.: US 8,262,307 B1
(45) Date of Patent: Sep. 11, 2012

(54) ATTACHABLE CONDIMENT APPLICATORS AND KIT THEREFOR

(76) Inventor: Thomas E. Cross, Barberton, OH (US)

( * ) Notice: Subject to any disclaimer, the term of this patent is extended or adjusted under 35 U.S.C. 154(b) by 1481 days.

(21) Appl. No.: 11/821,350

(22) Filed: Jun. 22, 2007

Related U.S. Application Data

(60) Provisional application No. 60/815,422, filed on Jun. 22, 2006.

(51) Int. Cl.
*A46B 11/04* (2006.01)
*A47L 13/22* (2006.01)

(52) U.S. Cl. ..... 401/280; 401/183; 401/281

(58) Field of Classification Search ..... 401/183–186, 401/194, 207, 268, 270, 276, 280, 281, 289
See application file for complete search history.

(56) References Cited

U.S. PATENT DOCUMENTS 3,106,741 A 10/1963 Stoner
4,726,386 A 2/1988 Schultz
4,790,679 A * 12/1988 Murphy ..... 401/270
4,958,596 A * 9/1990 Belan ..... 401/183
5,366,308 A * 11/1994 Crispino ..... 401/1
5,515,974 A * 5/1996 Higson ..... 206/570
5,547,303 A 8/1996 Pyrozyk
D376,479 S 12/1996 Bresler et al.
5,716,104 A 2/1998 Keating et al.
D400,358 S 11/1998 Zemel
5,934,296 A * 8/1999 Clay ..... 401/281
6,109,810 A 8/2000 Flores et al.
6,412,997 B2 * 7/2002 Berke et al. ..... 401/185
6,536,970 B2 * 3/2003 Hauser et al. ..... 401/186
6,575,651 B1 6/2003 Bertothy

* cited by examiner

*Primary Examiner* — Tuan N Nguyen
(74) *Attorney, Agent, or Firm* — Montgomery Patent & Design, LLC; Robert C. Montgomery; Joseph Yaksich

(57) ABSTRACT

A kit comprising various devices for supplying condiments thereto foodstuffs and stored therein a case is herein disclosed. The kit incorporates interchangeable brushes similar to a basting brush that threadably engages a squeezable condiment bottle containing catsup, mustard, barbecue sauce, glazes and the like. Unlike existing packaging, the condiments travel by squeeze pressure through a bottle opening, through a hollow handle, and subsequently onto bristles of an attached brush for application. The brush has a sanitary cover for storage and also comprises additional interchangeable cooking implements, such as, but not limited to flow tips and extension pieces.

7 Claims, 9 Drawing Sheets

ATTACHABLE CONDIMENT APPLICATORS AND KIT THEREFOR

RELATED APPLICATIONS

The present invention was first described in and claims the benefit of U.S. Provisional Application No. 60/815,422, filed Jun. 22, 2006, the entire disclosures of which are incorporated herein by reference.

FIELD OF THE INVENTION

The present invention relates generally to a unique system and method for the packaging and the application of foodstuffs such as ketchup, mustard, mayonnaise, barbecue sauce, glazes and, more particularly, to an interchangeable basting-like brush attached to the lid of a squeezable condiment bottle.

BACKGROUND OF THE INVENTION

Spending time in the great outdoors is among the most popular fair weather leisure time activities. Quite often, cooking and eating a meal is made part of the outdoor activity. Whether it is a family gathering, a picnic or a cookout, a great deal of time is spent around a barbeque grill. A usual part of the barbequing process is that of applying barbeque sauce, glazes, sauces or other condiments. This usually means pouring the sauce in the original bottle into a bowl, where a brush or other applicator can be used to apply it to the meat. This results in additional dirty dishes, wasted time and perhaps even wasted condiments.

Several attempts have been made in the past to design an effective means for dispensing condiments evenly from a bottle onto a food product. U.S. Pat. No. 6,109,810 in the name of Flores discloses a replacement top for a condiment bottle. The replacement top includes a cap member adapted to be received on an opening of a bottle. The cap member includes a fluid passage therethrough. A valve member is supported by the cap member for operatively opening and closing the fluid passage in the cap member. A brush portion is attached to the cap member in proximity to the fluid passage. Unfortunately, this prior art example does not provide various caps to fulfill the needs of basting different food products.

U.S. Pat. No. 4,726,386 in the name of Schultz discloses a liquid nail polish applicator having a bottle containing a supply of nail polish and a brush applicator on the open end of the bottle. The brush is supplied with nail polish liquid internally through the brush bottle upon the removal of the center seal from the open end of the bottle and upon inverting the bottle. Unfortunately, this prior art example is not designed for effectively basting a food product with any desired condiment.

U.S. Pat. No. 6,575,651 in the name of Bertothy describes a device that is useful for basting food products in the cooking process. More specifically, the device is useful by providing variable fluid flow capabilities to food product basting appliances. The food basting device comprises two separate pieces, a cap piece and a brush piece that work in rotating relationship with each other to prove variable fluid flow through the device. The food basting device preferably works with fluid containers that do not have screw threads for a cap or lid, such as a beer or soda can. Unfortunately, this prior art example is not designed to conveniently attach to a preexisting condiment bottle.

None of the prior art particularly describes detachable condiment applicators for the packaging and the application of foodstuffs such as ketchup, mustard, mayonnaise, barbecue sauce, glazes. Accordingly, there is a need for a means by which condiments can be applied directly to meats without the disadvantages described above.

SUMMARY OF THE INVENTION

In view of the foregoing disadvantages inherent in the prior art, it has been observed that there is need for detachable condiment applicators for the packaging and the application of foodstuffs such as ketchup, mustard, mayonnaise, barbecue sauce, glazes.

A condiment applicator includes an applicator cap removably connected to the existing first container and an interchangeable applicator head removably connected to the applicator cap and in fluid communication therewith the first container. Such an applicator head further includes a tufted bristle applicator situated below the slot such that the condiment is dispensed along a travel path defined perpendicular to a longitudinal length of the applicator head, and a conduit in fluid communication with the applicator head collar. The applicator head further includes a heat shield effectively connected thereto.

The applicator head is provided with a slot formed therein, and includes at least one of a slide plate and a rotary plate respectively seated within the slot. Each of such slide and rotary plates conveniently includes first and second apertures selectively alignable with a dispensing end of an applicator head collar when the slide plate and the rotary plate are biased to a predetermined positioned defined subjacent to the dispensing end. The rotary plate is rotatably adaptable within the slot such that the first and second apertures become vertically aligned beneath the dispensing end of the applicator head collar. The slide plate is linearly adaptable along a rectilinear path defined within the slot, and is provided with a pair of stop pins located upon an upper surface thereof such that the stop pins engage outer edges of the applicator head and thereby prevent linear movement of the slide plate.

The condiment applicator further includes an extension conduit connected to the applicator cap. Such an extension conduit advantageously has a rectilinear tubular shape and further has a collar and a medial portion integrally formed with the collar. The extension conduit further has a male attachment axially opposed from the collar and integrally formed with the medial portion.

The condiment applicator further includes a flow tip connected to the extension conduit. Such a flow tip includes a mechanism for effectively controlling a flow rate of the condiment. Such a flow rate controlling mechanism is housed within the flow tip and includes a restrictor tube with an inside diameter smaller than a diameter of the flow tip. The flow tip further includes a female collar in fluid communication with a conduit, and a male attachment axially opposed from the female collar. The condiment applicator further includes a cover slidably positional over the applicator head for conveniently shielding the applicator head from foreign debris during non-use and a carrying case including a plurality of recessed compartments and an interior foam rubber padding lined within the recessed compartments.

A method for dispensing a condiment from an existing container includes the steps of: providing a first container housing a predetermined quantity of the condiment; attaching a heat shield to an applicator head; attaching an applicator cap to the first container; attaching at least one extension conduit to the applicator cap; attaching a flow tip to the at least one extension conduit and the applicator head respectively; and squeezing the first container to thereby force the condiment to travel through the applicator cap and the extension conduit and the flow tip and the applicator head respectively.

The method further includes the steps of: sliding a cover over the applicator head; and storing the applicator head and the applicator cap and the extension conduit and the flow tip within a carrying case. The steps further include: inserting a rectangular plate within a slot formed within the applicator head, the plate including first and second apertures; and linearly adapting the plate along a rectilinear path until at least one of the first and second apertures is vertically aligning beneath a dispensing end of an applicator head collar.

The method further includes the steps of: inserting a circular plate within a slot formed within the applicator head, the plate including first and second apertures; and rotatably adapting the plate along a rectilinear path until at least one of the first and second apertures is vertically aligning beneath a dispensing end of an applicator head collar.

The innovative packaging apparatus is brush-type that screws onto squeezable condiment bottles such as barbeque sauce. To use the invention, the user unscrews the bottle cap that is supplied with the condiment and attaches it to the invention instead. Then, as the user squeezes the bottle, the contents travel up a long tube that is approximately nine inches in length. At the opposite end of the tube, a brush, similar in nature to a basting brush, is provided. The condiment emerges from the tube at the brush end and spreads over the bristles. From there the condiment can be spread over meats such as beef or chicken that are typically barbequed. While it is envisioned that the invention would most likely be used with barbeque sauce, it can be used with other condiments such as glazes, basting sauces, gravy, ketchup, mayonnaise or the like. Such features allow for the application of the condiment without touching it or pouring it into another container. The use of the innovative apparatus allows one to prepare foods that require the application of condiments in a manner, which is quick, easy and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
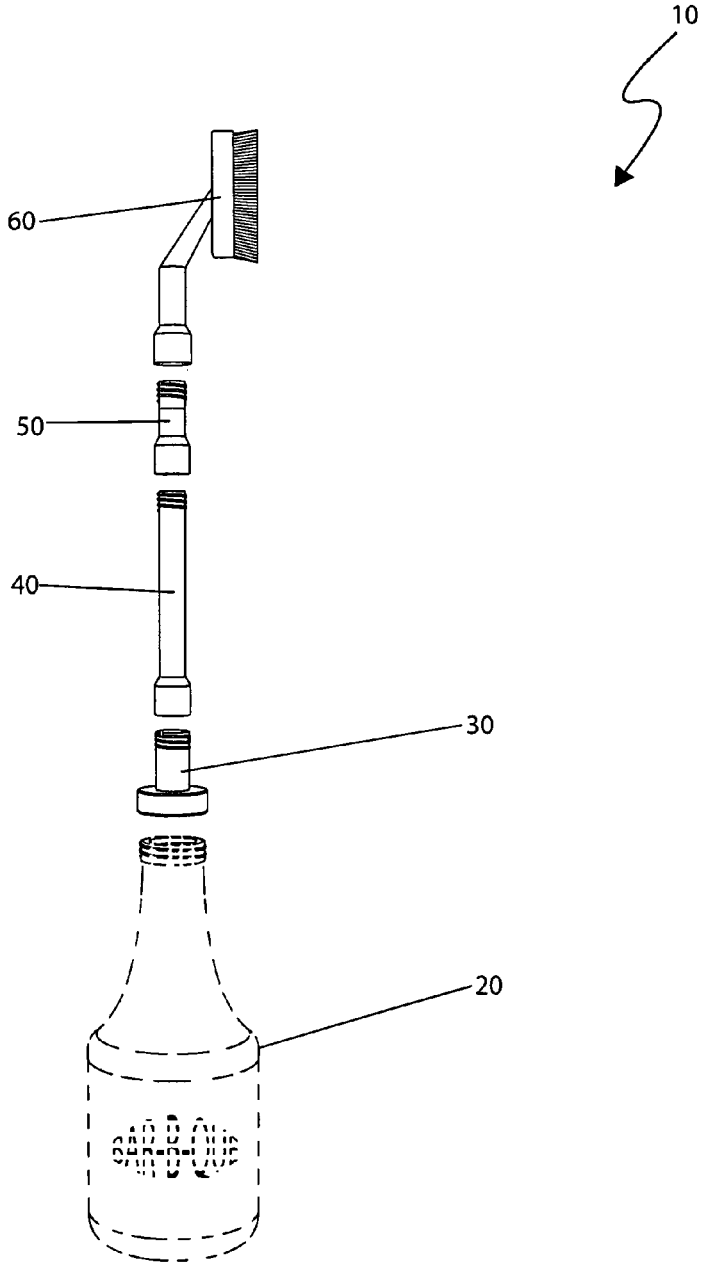
FIG. 1 is an exploded view of attachable condiment applicators and a kit therefore 10, according to the preferred embodiment of the present invention.

| | |
|---|---|
| 10 | attachable condiment applicators and kit therefore |
| 20 | first container |
| 21 | second container |
| 22 | container attachment |
| 23 | heat shield |
| 30 | applicator cap |
| 31 | first collar |
| 32 | first conduit |
| 33 | first male attachment |
| 34 | dispensing nozzle |
| 35 | alternate applicator cap |
| 40 | extension conduit |
| 41 | second collar |
| 42 | second male attachment |
| 43 | second conduit |
| 50 | flow tip |
| 51 | third collar |
| 52 | third conduit |
| 53 | third male attachment |
| 54 | restrictor tube |
| 60 | bristle applicator head |
| 61 | fourth collar |
| 62 | fourth conduit |
| 63 | dispenser head |
| 64 | bristle applicator |
| 65 | cover |
| 66 | sponge applicator |
| 67 | fabric applicator |
| 68 | dispersing aperture |
| 70 | carrying case |
| 71 | compartment |
| 72 | handle |
| 73 | upper portion |
| 74 | lower portion |
| 75 | hasp |
| 76 | hinge |
| 77 | padding |
| 80 | slide plate |
| 81 | rotary plate |
| 82 | large aperture |
| 83 | small aperture |
| 84 | stop pin |
| 85 | indicia |
| 90 | condiment/fluid |
| 91 | fluid flow |
| 92 | squeezing motion |
| 93 | sliding motion |
| 94 | rotating motion |
| 100 | sponge applicator head |
| 110 | fabric applicator head |

DETAILED DESCRIPTION OF THE PREFERRED EMBODIMENT

The best mode for carrying out the invention is presented in terms of its preferred embodiment, herein depicted within FIGS. 1 through 8*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for attachable condiment applicators and a kit therefor 10 (herein described as the "apparatus") 10, which provides a means for aiding in application of various condiments/fluids 90 such as catsup, mustard, barbecue sauce, glazes, and the like with a plurality of applicators in a carrying case 70. The apparatus 10 comprises a first container 20, a plurality of extension conduits 40, an interchangeable applicator head 60, and a means to connect said assemblies to each other. The apparatus 10 further provides a customized padded carrying case 70 for the transportation and storage of the various applicators. The apparatus 10 is envisioned to be fabricated using durable materials capable of withstanding high temperatures and frequent use. Additionally, the apparatus 10 may be used to contain and dispense a variety of fluids such as various medicinal ointments, cleaning fluids, and the like, therefore being useful in a wide range of applications.

Referring now to FIG. 1, an exploded view of the apparatus 10, according to the preferred embodiment of the present invention, is disclosed. The apparatus 10 comprises a first container 20 envisioned to contain catsup, mustard, barbecue sauce, glazes, or other commercially available condiment/fluids 90. The apparatus 10 may be utilized as a single unit comprising the dispenser/applicator portions and a first container 20 to the cooking area permitting quick and convenient application of sauces to foods and can be left on said first container 20 until the contents thereof have been fully dispensed.

The first container 20 further comprises a common purchased squeeze type container providing said condiment/fluids 90. The first container 20 is envisioned to provide common features such as, but not limited to; a handle, grips, recessed finger sections, or the like. The first container 20 also defines an interior compartment for housing a condiment/fluid 90 and an open top portion providing a container attachment 22. The container attachment 22 is envisioned to be a threaded or grooved male feature common to commercially available condiment products. Said container attachment 22 provides an attachment means to an applicator cap 30 via a threaded or a snap-on female feature therein (see FIG. 3*a*). The applicator cap 30 provides further attachment at an upper location thereupon to an extension conduit 40 via a male/female threaded connection (see FIG. 4).

The extension conduit 40 further provides an attachment means at an upper location thereupon to a flow tip 50 using a male/female connection similar to the aforementioned applicator cap 30 connection. The flow tip 50 provides a flow restriction means via a reduced inside diameter, thereby controlling the flow characteristics of condiment/fluids 90 of lesser viscosity such as oils, glazes, or the like. It is envisioned that the flow tips 50 would be provided as a graduated set of three (3) or four (4) devices (see FIG. 5). The flow tip 50 provides an attachment means at an upper location thereupon to an applicator head 60 using a male/female connection similar to the aforementioned applicator cap 30 connection. The applicator head 60 comprises a dispensing device utilizing tufted bristles attached thereto. The applicator head 60 is envisioned to redirect and dispense the condiment/fluid 90 in a perpendicular direction relative to a longitudinal axis of the apparatus 10, thereby providing a convenient angled distribution means of said condiment/fluid 90 upon meats and other food surfaces via a tufted bristle applicator 64 (see FIG. 6*a*). The condiment/fluid 90 conveying components of the invention 10 described herein are envisioned to be made using durable plastic materials such as polypropylene, acrylonitrile butadiene styrene (ABS), or the like.

Figure 2:
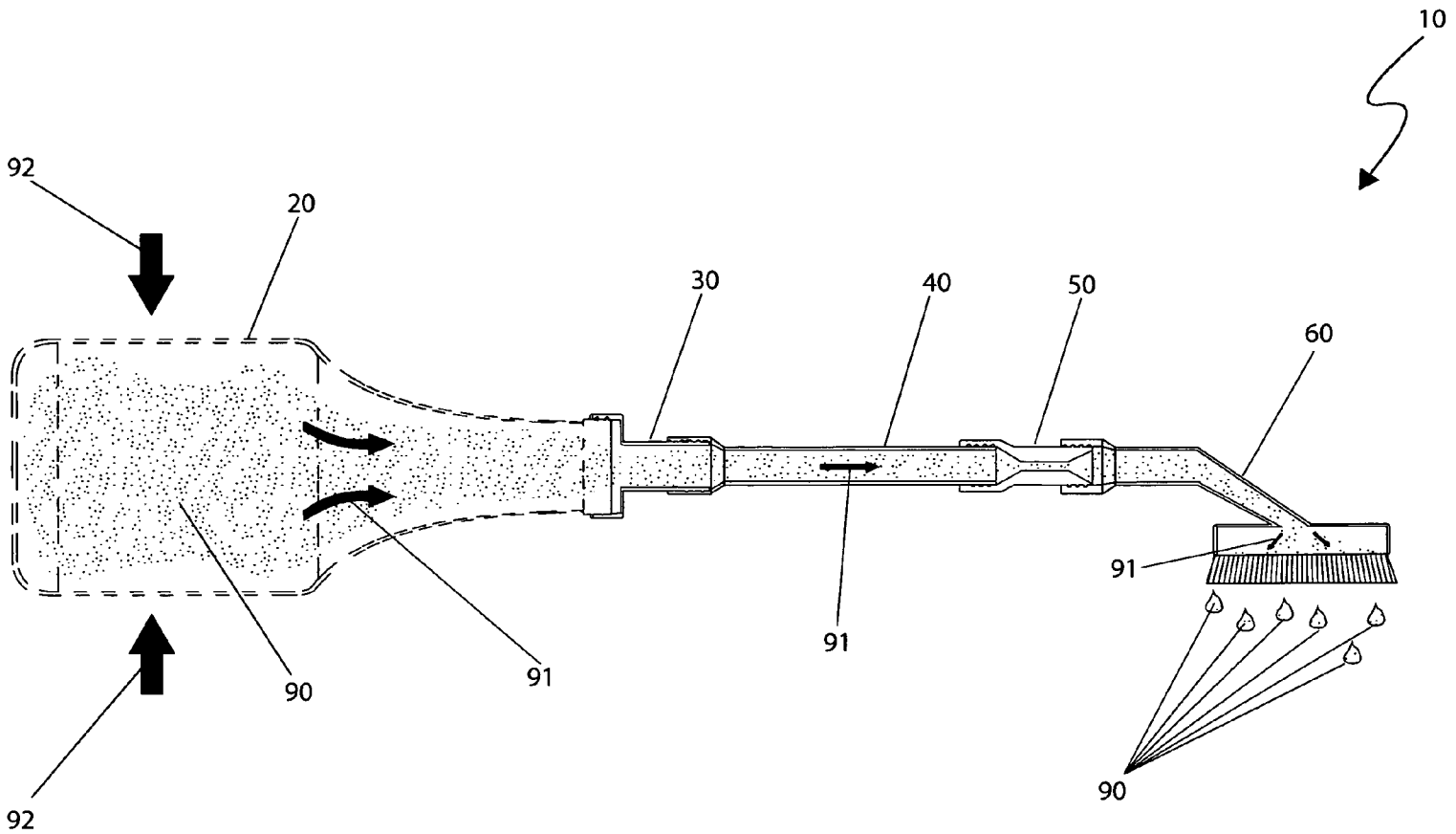
FIG. 2 is a side cut-away view of attachable condiment applicators and a kit therefore 10 depicting fluid flow 91 therein, according to the preferred embodiment of the present invention.

Referring now to FIG. 2, a side cut-away view of the apparatus 10 depicting fluid flow 91 therein, according to the preferred embodiment of the present invention, is disclosed. The apparatus 10 as illustrated here depicts a linear fluid flow 91 of condiment/fluids 90 from a compressed first container 20 to an applicator head 60. Said fluid flow 91 is initiated via a manual squeezing motion 92 of the first container 20 providing an expected fluid communication propelling said condiment/fluids 90 in a forward direction in turn through the applicator cap 30, the extension conduit 40, the flow tip 50, and finally being dispensed from the applicator head 60. The flow tips 50 provide a flow control means to said condiment/fluids 90 via a restrictor tube 54 providing a reduced inside diameter correspondingly suitable thereto condiment/fluids 90 with low viscosities.

Figure 3A:
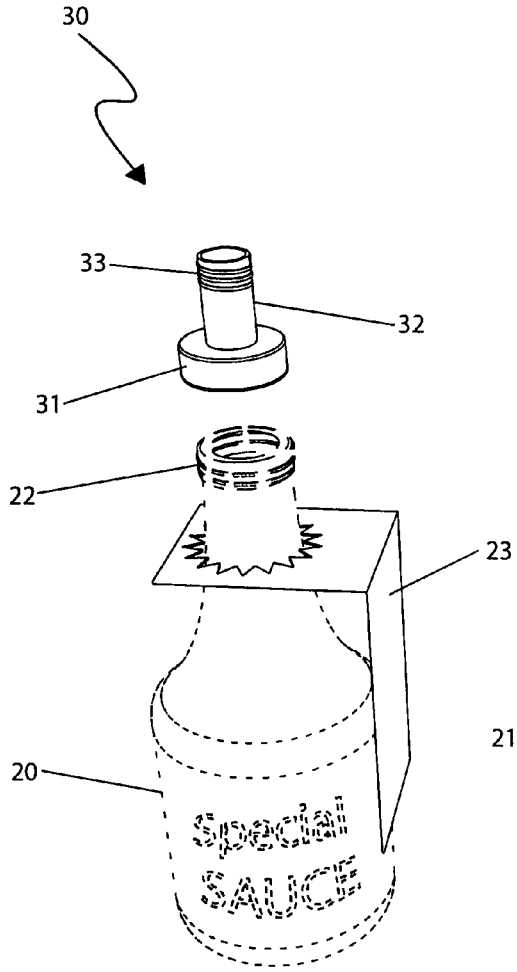
FIG. 3*a* is a perspective view of an applicator cap 30 and heat shield portion 23, according to the preferred embodiment of the present invention.

Referring now to FIG. 3*a*, a perspective view of an applicator cap portion 30 and a heat shield 23, according to the preferred embodiment of the present invention, is disclosed. By providing the apparatus 10 with an applicator cap 30 having a standard connection means, the apparatus 10 may be used directly on conventional sauce containers 20.

The first container 20 comprises an outer wall defining a threaded or grooved container attachment 22 positioned at an upper opening for receiving and cooperating with the first collar portion 31 of the applicator cap 30.

The applicator cap 30 comprises an inside wall defining a first collar 31 for receiving said threaded or grooved container attachment portion 22, thereby disposing the condiment/fluid 90. The applicator cap 30 also comprises a first conduit 32 and a first male attachment 33 providing connection to and fluid flow 91 toward, an extension conduit 40 (see FIG. 4).

Also illustrated is a heat shield 23 which may be used in conjunction with either the first container 20 or second container 21 (see FIG. 3*b*), and is to be affixed at a circumferential location thereupon the container attachment portion 22 via an opening centrally located upon an upper surface of said heat shield 23. The heat shield 23 is envisioned to protect a user's hand and/or the container 20, 21 from heat when the apparatus 10 is used in proximity to a heat source. The heat shield 23 is envisioned being made using heat reflective materials such as metal foil covered fabrics, fire resistant fiber or plastic based panels, or the like.

Figure 3B:
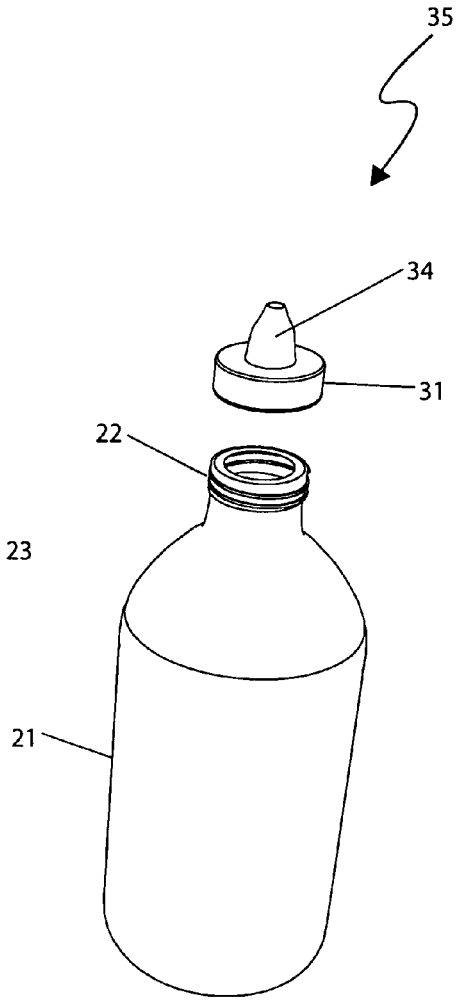
FIG. 3*b* is a perspective view of an applicator cap 35 and a second container 21, according to alternate embodiments of the present invention.

Referring now to FIG. 3*b*, a perspective view of an applicator cap 35 and a second container 21, according to alternate embodiments of the present invention, are disclosed. In the event that the container attachment portion 22 of the purchased first container 20 is of a non-standard connection type, an alternate second container 21 provides a compressible vessel means which is similar to the first container 20; however, particular features enabling correct attachment to said applicator cap 35 are also provided. Said condiment/fluids 90 would be either transferred from said first container 20 or obtained from an alternate source and poured into the second container 21, thereby allowing an intended application of said condiment/fluids 90 using the apparatus 10. The second container 21 is depicted here as a common cylindrical-shaped plastic squeeze bottle, however said second container 21 may be provided in a variety of shapes and capacities and as such should not be interpreted as a limiting factor of the present invention 10. The second container 21 is envisioned to be made using a polyethylene material common in the plastic bottle industry.

The alternate applicator cap 35 as illustrated here features a dispensing nozzle 34 which provides an integrally reducing dispersing aperture being suitable for immediate table use in lieu of additional condiment dispensing apparatus 10. The alternate applicator cap 33 may be used in conjunction with the first 20 or second 21 containers via a first collar 31 in a similar manner as the preferred embodiment of said applicator cap 30.

Figure 4:
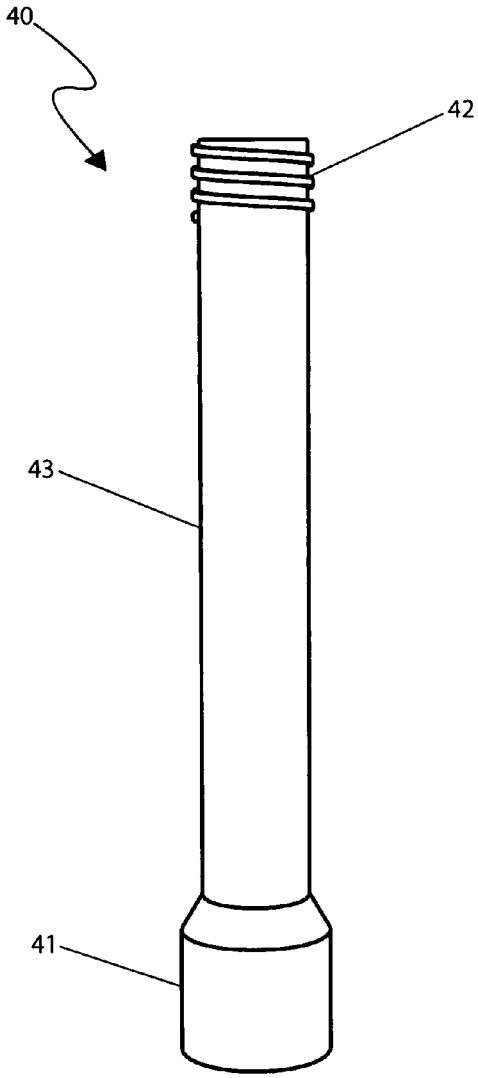
FIG. 4 is a perspective view of an extension conduit portion 40, according to the preferred embodiment of the present invention.

Referring now to FIG. 4, a perspective view of an extension conduit portion 40, according to the preferred embodiment of the present invention, is disclosed. The extension conduit 40 comprises a tubular member therein operable to a condiment/fluid 90 communication with either said preferred applicator cap 30 or said alternate applicator cap 35. The extension conduit 40 is envisioned to be provided in a plurality of lengths ranging from six (6) to twelve (12) inches long, thereby providing a configurable length to the apparatus 10 during the application of condiments/fluids 90. The extension conduit 40 is envisioned to be provided as a graduated set of three (3) or four (4) pieces comprising various lengths. The extension conduit 40 comprises a second collar 41, a second conduit 43, and a second male attachment 42. The second collar 41 is envisioned to be similar to the aforementioned first collar 31 and provides a female attachment means to said applicator caps 30, 35. The second conduit 43 provides a relatively straight and rigid fluid conduit with a uniform inner diameter between the second collar 41 and the second male attachment 42. The second male attachment 42 provides an attachment means to an additional extension conduit portion 40, a flow tip 50, or an applicator head 60.

Figure 5:
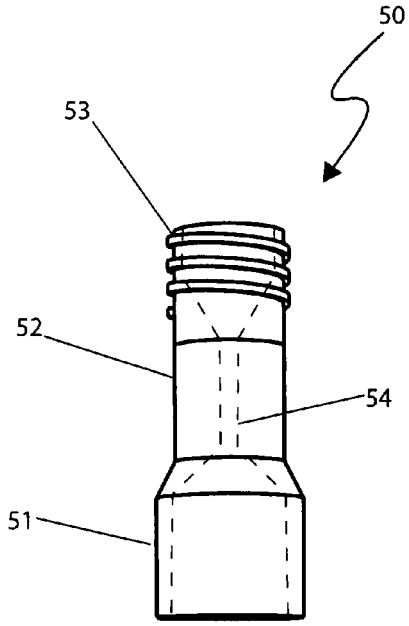
FIG. 5 is a perspective view of a flow tip portion 50, according to the preferred embodiment of the present invention.

Referring now to FIG. 5, a perspective view of a flow tip portion 50, according to the preferred embodiment of the present invention, is disclosed. The flow tip 50 comprises a third collar 51, a third conduit 52, and a third male attachment 53. The flow tip 50 provides a flow control means to communicated condiment/fluids 90 via a third conduit 52 which further comprises an internal restrictor tube 54. It is envisioned that the apparatus 10 would be provided with a series of three (3) or four (4) flow tips 50 comprising of graduated restrictor tubes 54, thereby allowing use of the invention 10 to dispense and apply a wide variety of condiments/fluids 90 of differing viscosities. The third collar 51 and the third male attachment 53 are envisioned to be similar to the aforementioned applicator caps 30, 35. Said third collar 51 and third male attachment 53 are envisioned to provide an attachment means to the extension conduit 40 and applicator head 60, respectively. The flow tip 50 is envisioned to be used in conjunction with the applicator head 60; however, said flow tip 50 may be used without the applicator head 60 to dispense said condiment/fluids 90 directly onto a food surface if desired.

Figure 6A:
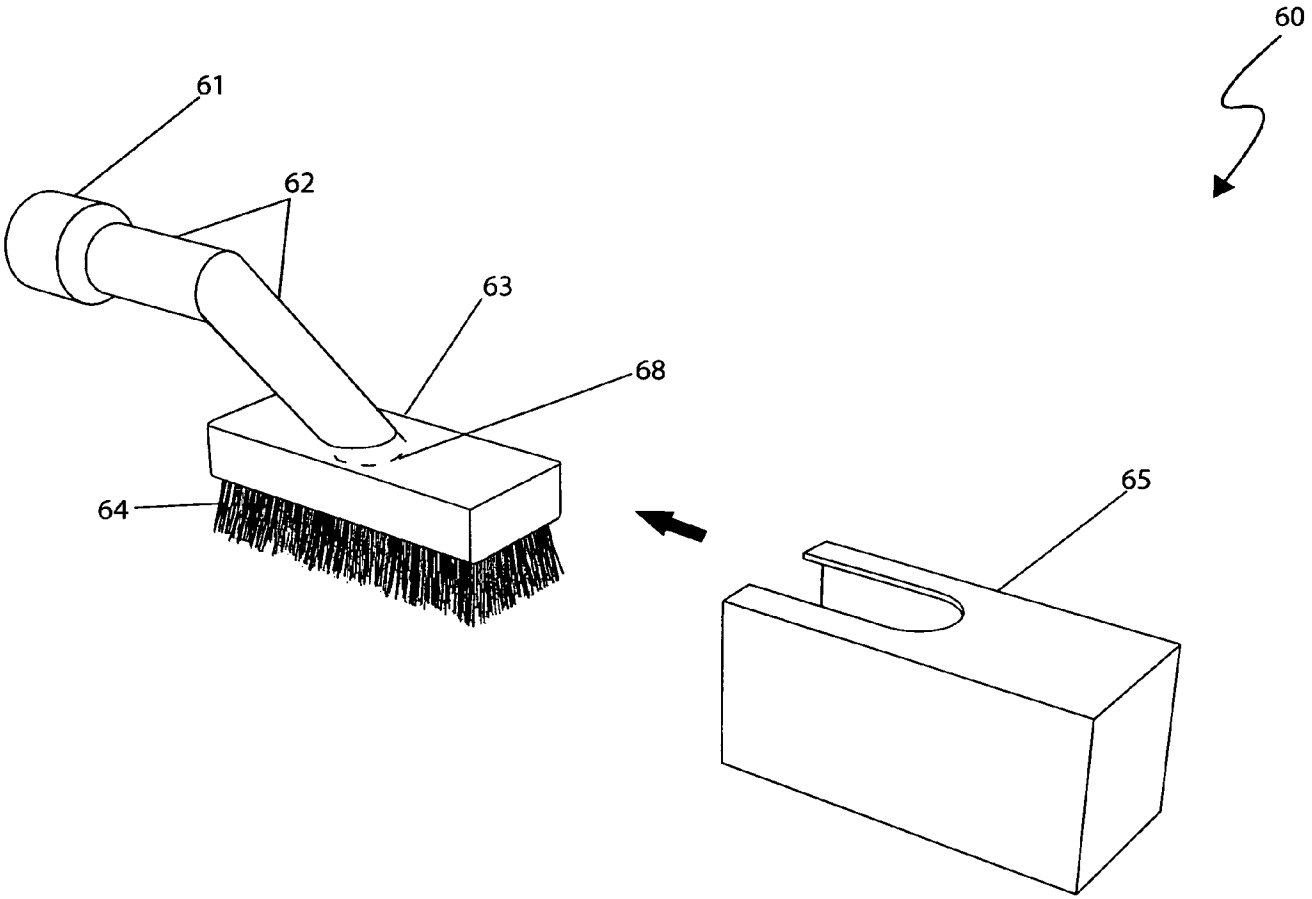
FIG. 6*a* is a perspective view of an applicator head 60 and cover 65 portion, according to the preferred embodiment of the present invention.

Referring now to FIG. 6*a*, a perspective view of an applicator head 60 and cover 65 portion, according to the preferred embodiment of the present invention, is disclosed. The apparatus 10 is envisioned to comprise an interchangeable applicator head 60 comprising a fourth collar 61, a fourth conduit 62, a dispenser head 63, and a tufted bristle applicator 64. The applicator head 60 is envisioned to provide a dispensing surface parallel to the longitudinal axis of the apparatus 10. The applicator head 60 is to be removably secured thereto such to permit adjustments of the applicator head 60 before, during, and/or after use of the apparatus 10. The fourth collar 61 receives condiment/fluid 90 from a flow tip 50 or an extension conduit 40. Said condiment/fluids 90 are redirected and communicated in a generally perpendicular direction with respect to the longitudinal axis of the apparatus 10 through the fourth collar 61, the fourth conduit 62, and are subsequently dispensed therethrough the dispersing aperture 68. The dispenser head 63 provides an attachment means to the fluid dispersing aperture 68 which is in direct correspondence with the bristle applicator 64 thereby dispersing the received condiment/fluid 90 therethrough. The bristle applicator 64 comprises a plurality of tufted bristles embedded thereto the dispenser head 63.

The bristle portion of the bristle applicator 64 may be provided in a variety of sizes and/or configurations including shapes such as disc, rectangular, oval, or various other regular or irregular shapes. The bristle applicator 64 is preferably, but not essentially, fabricated of the same material found in common basting brushes.

Additionally, the apparatus 10 comprises a cover 65 providing a means to contain the applicator head 60 as well as the alternate applicator head designs 100, 110 after utilization of the apparatus 10. The cover 65 comprises a rectangularly-shaped slip-on enclosure having five (5) sides and a slot located thereupon a top surface which engages the fourth conduit portion 62. The cover 65 is envisioned to completely encapsulate the applicator head 60 to reduce exposure of said applicator heads 60, 100, 110 to air thereby providing optimal sanitation. The cover 65 is envisioned to be made using washable plastic or metal materials.

Figure 6C:
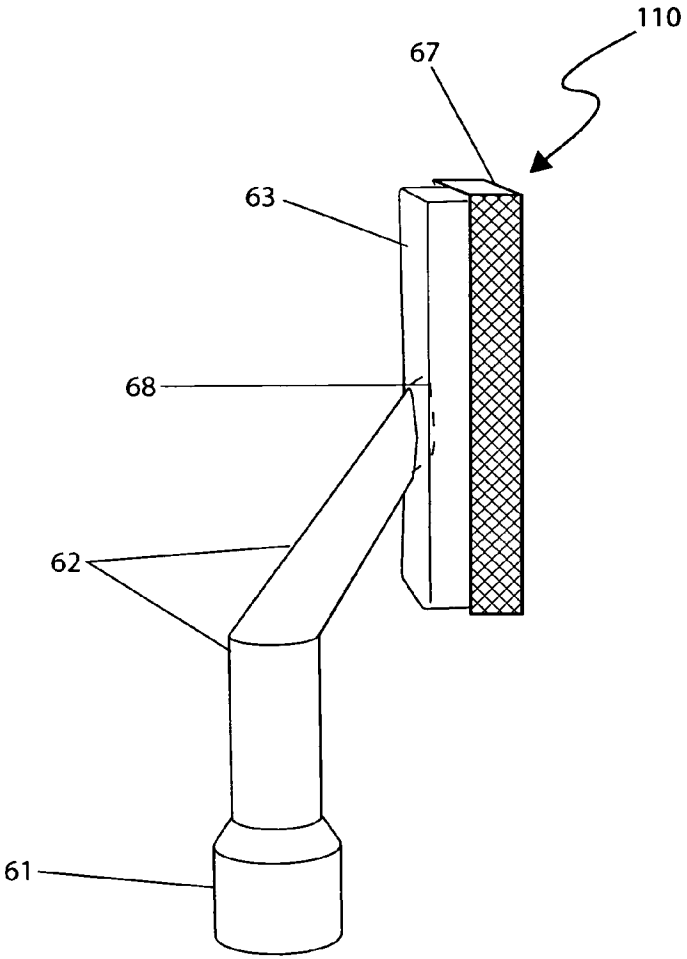
FIG. 6*c* is a perspective view of a applicator head 110 with fabric applicator 67 according to an alternate embodiment of the present invention.
Figure 6B:
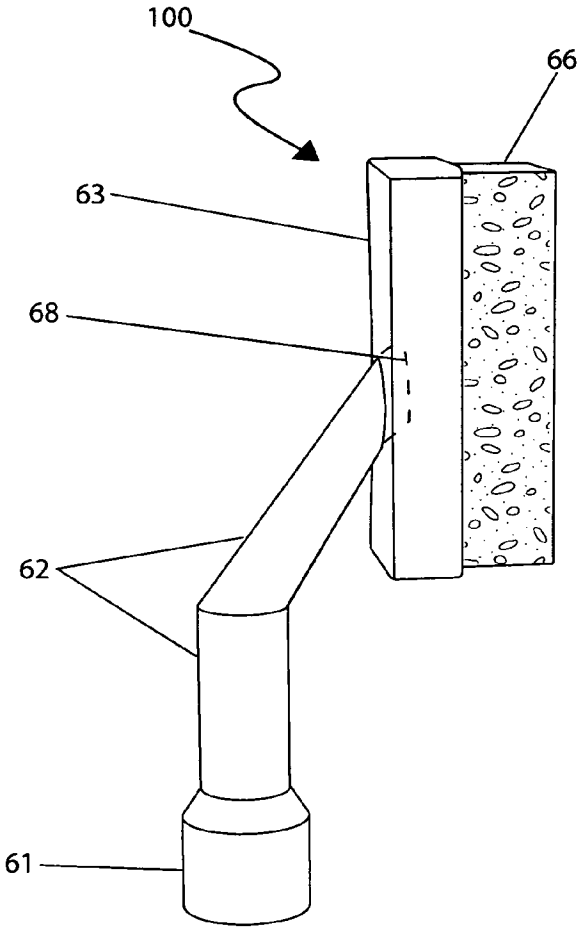
FIG. 6*b* is a perspective view of a applicator head 100 with sponge applicator 66 according to an alternate embodiment of the present invention.

Referring now to FIGS. 6*b* and 6*c*, perspective views of a sponge applicator head 100 and a fabric applicator head 110, respectively, according to an alternate embodiment of the present invention, are disclosed. The apparatus 10 may be provided with alternate applicator head designs 100, 110 utilizing either an open-cell sponge material 66 or a fabric material 67 as illustrated here. It is envisioned that the fluid communication portions of the said alternate head designs 100, 110 including the fourth collar 61, the fourth conduit 62, the dispenser head 63, and the dispersing aperture 68 comprise a similar design and functionality as the preferred embodiment of the applicator head 60.

Figure 7:
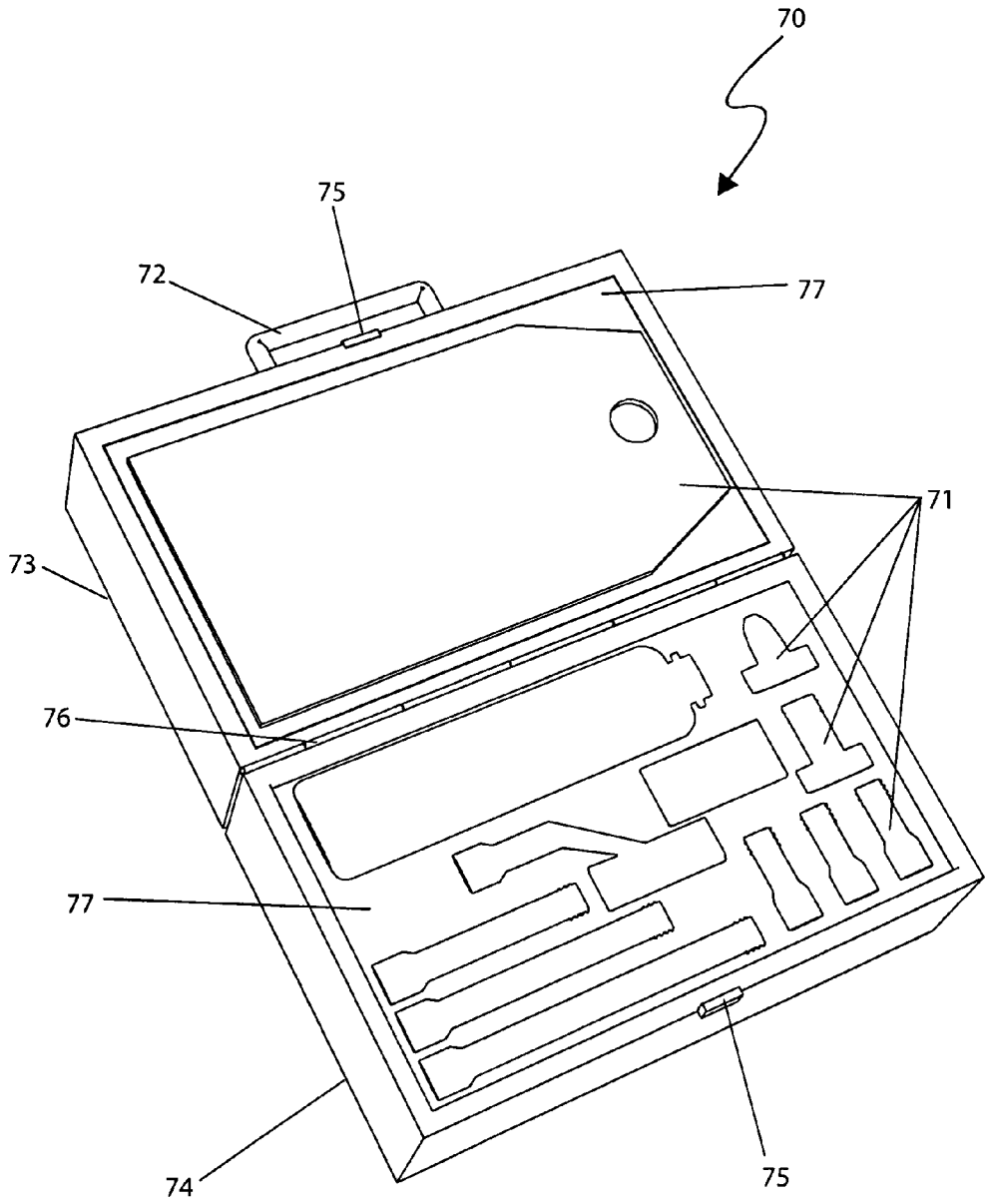
FIG. 7 is a perspective view of a carrying case portion 70, according to the preferred embodiment of the present invention.

Referring now to FIG. 7, a perspective view of a carrying case portion 70, according to the preferred embodiment of the present invention, is disclosed. The apparatus 10 further comprises a customized carrying case 70. The carrying case 70 which provides a transportation and protection means to both the preferred and alternate portions of the invention 10. The carrying case 70 comprises an interior foam rubber padding 77 further comprising a plurality of recessed compartments 71 shaped correspondingly to various parts of the invention 10 providing a secure containment of said portions of the apparatus 10 within. The carrying case 70 is depicted here in the form of a rectangular-shaped two-piece center-folding enclosure similar to a standard briefcase; however, the carrying case 70 may be provided in a variety of shapes, colors, and patterns and as such should not be interpreted as a limiting factor of the present invention 10. Additionally, said carrying case 70 comprises standard features such as an upper portion 73, a lower portion 74, a handle 72, a hasp 75, a hinge 76, and sufficient foam rubber padding 77 designed to provide sufficient mechanical protection to the invention 10. The carrying case 70 is envisioned to be made using durable materials such as metal, plastic, fiberglass, or the like.

Figure 8A:
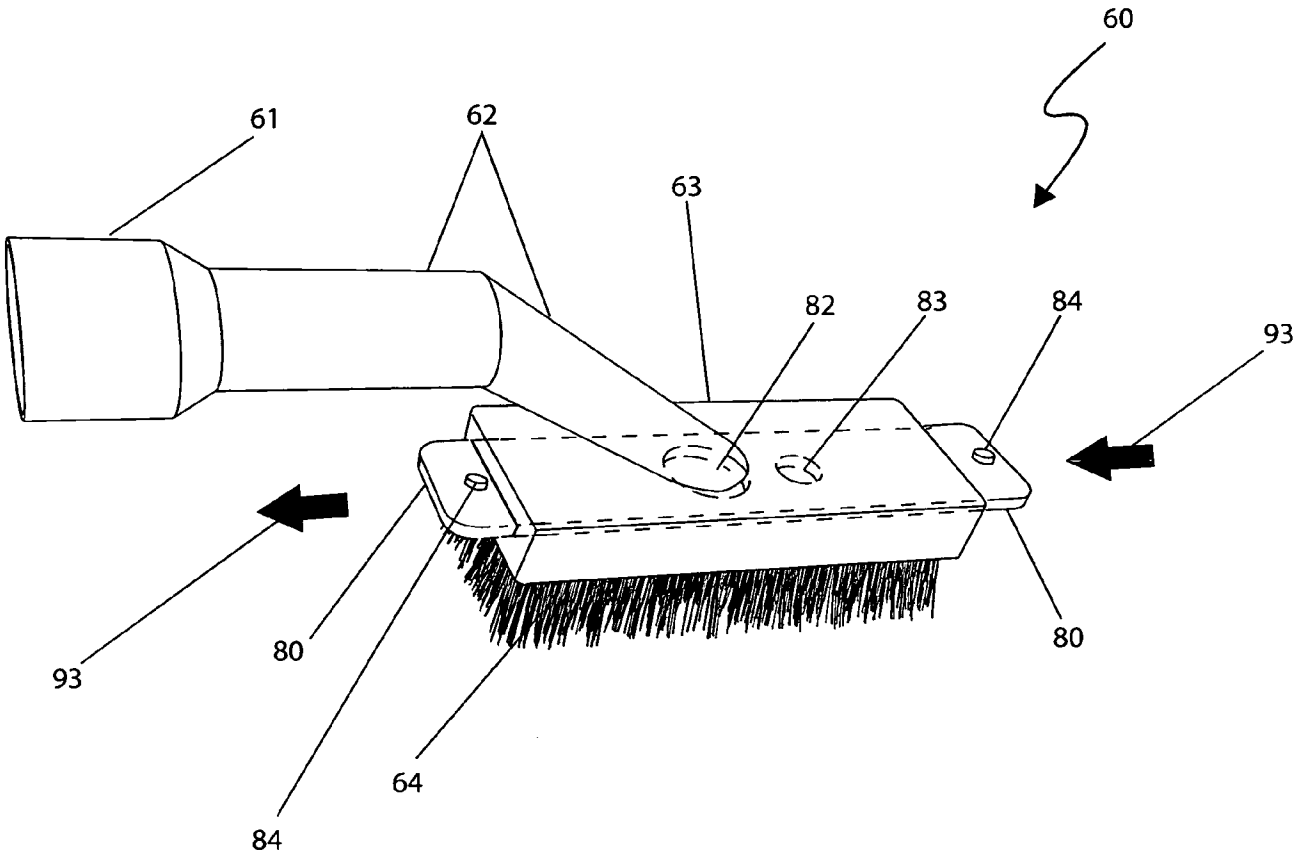
FIG. 8*a* is a perspective view of an applicator head 60 incorporating a slide plate 80, according to an alternative embodiment of the present invention; and, FIG. 8*b* is a perspective view of an applicator head 60 incorporating a rotary plate 81, according to an alternative embodiment of the present invention.
Figure 8B:
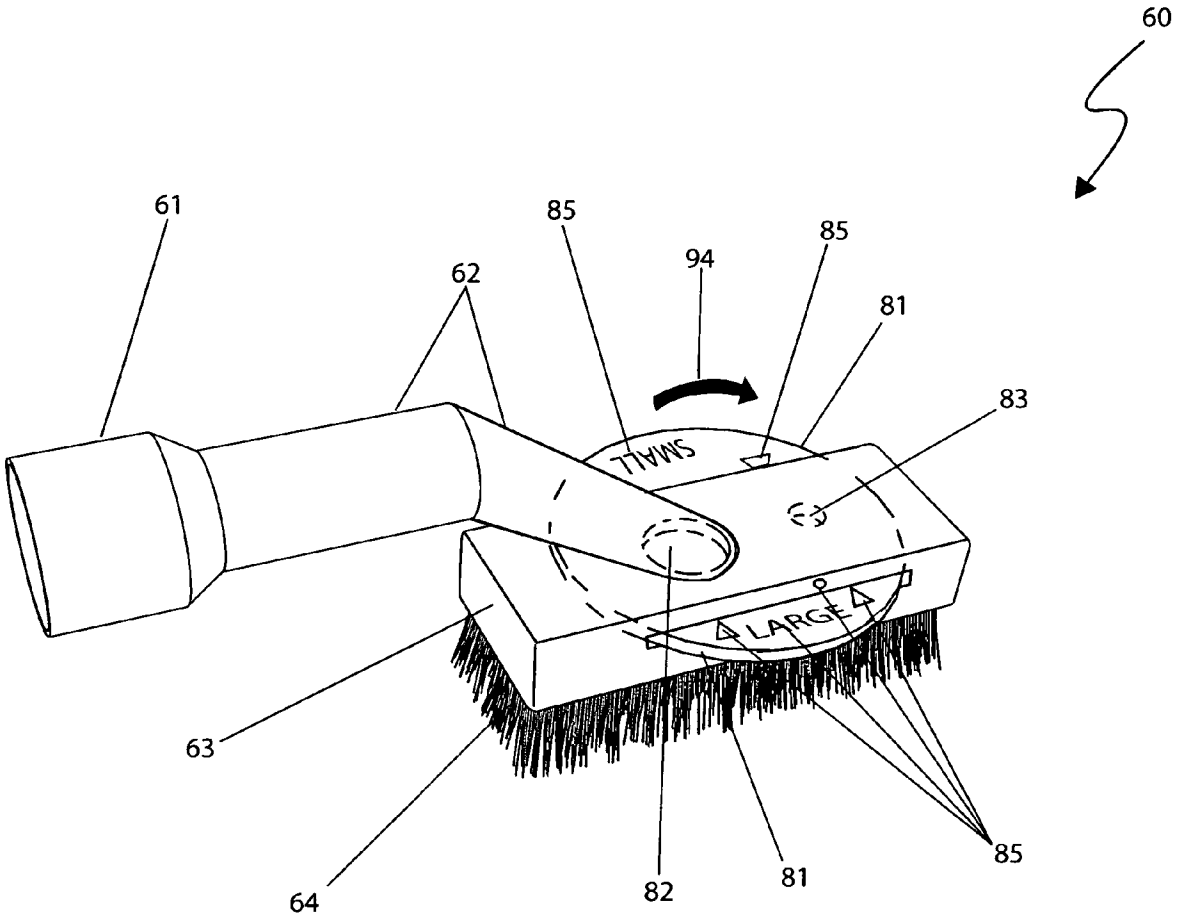

Referring now to FIGS. 8*a* and 8*b*, perspective views of an applicator head 60 incorporating a slide plate 80 and a rotary plate 81, respectively, according to an alternative embodiment of the present invention, are disclosed. Illustrated here are alternative applicator head 60 designs which provide effective flow control to condiment/fluids 90 having varying viscosities. Depicted here are a rotary plate 81 and a slide plate 80 design, both comprising a large aperture 82 and a small aperture 83, each of which are manually selectively introduced thereinto the fluid flow path 91 by repositioning said plates 80, 81, thereby regulating flow of said condiments/fluids 90 therethrough. The plates 80, 81 are envisioned to be made using corrosion resistant materials such as plastic, stainless steel, or the like. The slide plate 80 is envisioned to provide a lateral sliding motion 93 to align and select the apertures 82, 83 with the fluid flow 91. The slide plate 80 is positioned via a pair of stop pins 84 located upon an upper surface. In like manner, the rotary plate 81 is envisioned to provide similar functionality as the aforementioned slide plate 80; however, selection and alignment of the apertures 82, 83 is envisioned to be accomplished by initiating a rotary motion 94 of said plate 81 until certain indicia 85 located upon the rotary plate 81 and the dispenser head portion 63, are aligned.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1 and alternately as depicted in FIGS. 3*b*, 6*b*, 6*c*, 8*a*, and 8*b*.

The method of assembling and utilizing the apparatus 10 may be achieved by performing the following steps: procuring a desired condiment/fluid 90; selecting a desired surface to be basted, glazed, or other applicable procedures; providing a first container 20 containing a desired condiment/fluid 90 content within; attaching the heat shield 23 thereon the first container 20 by inserting the container attachment portion 22 through an opening in the heat shield 23; attaching the applicator cap 30 using the first collar portion 31 thereto the corresponding container attachment portion 22; attaching any combination of extension conduits 40 to the applicator cap 30 using the first male attachment portion 33 and the second collar portion 41 resulting in an apparatus 10 of desired length; attaching, if necessary, a flow tip 50 using the second male attachment portion 42 and the third collar 51 to obtain a desired flow rate of the condiment/fluid 90 through the apparatus 10; attaching the applicator head 60 to the flow tip 50 using the fourth collar portion 61 and the third male attachment portion 53; squeezing the first container 20 with a squeezing motion 92, thereby forcing condiment/fluids 90 to travel therethrough the applicator cap 30, the extension conduit 40, the flow tip 50, and finally the applicator head 60 thereby dispersing the condiment/fluid 90 along the bristle applicator 64; applying condiment/fluids 90 thereon the desired food surface; sliding the cover 65 over the dispenser head 63 to temporarily store the apparatus 10 until needed again; repeating use of the invention 10 until the condiment/fluids 90 are extinguished; storing the apparatus 10 within the carrying case 70 until needed again.

The use of an alternate second container 21 may be utilized in the event that a purchased first container 20 comprises a non-standard container attachment portion 22 and is therefore mechanically incompatible with the applicator cap 30; or in the event a user desires to create his/her own condiment/fluid 90. The alternate second container 21 would then be filled with a desired condiment/fluid content 90 and dispensed as described previously. Additionally, the use of the alternate applicator cap 35 with dispensing nozzle 34 may be used in conjunction with said second container 21 for normal table dispensing of said condiment/fluids 90.

It should be stated that the apparatus 10 may comprise any number of assembled configurations using any combination of the aforementioned dispensing components resulting in a desired result. Furthermore, the extension conduits 40, the flow tips 50, and the applicator heads 60 may be added or subtracted entirely to obtain additional condiment/fluid 90 dispensing effects.

The method for obtaining a desired fluid flow 91 of condiment/fluids 90 having various viscosities may be obtained using the aforementioned flow tips 50 or using alternate applicator head 60 designs incorporating a slide plate 80 or a rotary plate 81. The method for utilizing said alternate applicator head 60 designs may be achieved by performing the following steps: choosing either a large aperture 82 or a small aperture 83 by manually sliding 93 said slide plate 80 until the stop pin 84 is contacted, thereby positioning the desired aperture 82, 83 thereinto the fluid flow 91; or choosing the desired aperture 82, 83 by manually rotating 94 said rotary plate 81 until achieving alignment of particular alignment indicia 85, thereby positioning the desired aperture 82, 83 thereinto the fluid flow 91.

An alternate method for dispersing and applying condiment/fluids 90 upon a surface may be achieved by utilizing another alternate applicator head 60 design comprising a sponge 66 or fabric 67 applicator portion.

Finally, the apparatus 10 may be utilized to contain and dispense various non-food liquid materials such as medicinal ointments, cleaning fluids, and the like, therefore being useful in a wide range of applications.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A condiment applicator attachable to an existing container housing a predetermined quantity of a condiment, said condiment applicator comprising:

an applicator cap removably connected to the existing container; and an interchangeable applicator head removably connected to said applicator cap and being in fluid communication with the container, said applicator head comprising a dispenser head having first and second linear longitudinal walls extending along an entire longitudinal thereof, an applicator head collar removably coupled to said applicator cap and provided with a dispensing end in fluid communication with said dispenser head, and a rotary plate rotatable relative to said dispenser head, said rotary plate including first and second apertures selectively aligned with said dispensing end;

wherein said rotary plate has a diameter greater than a maximum width of said applicator head, said rotary plate further having first and second opposing curvilinear portions simultaneously exposed beyond said first and second linear longitudinal walls of said applicator head, respectively;

wherein each of said first and second opposing curvilinear portions has a circumferential length equal to less than half of a total circumferential length of said rotary plate.

2. The condiment applicator of claim 1, further comprising: an extension conduit connected to said applicator cap, said extension conduit having a rectilinear tubular shape and further having a collar and a medial portion integrally formed with said collar, said extension conduit further having a male attachment axially opposed from said collar and integrally formed with said medial portion.

3. The condiment applicator of claim 2, wherein said applicator head further comprises:

a tufted bristle applicator situated below said slot such that the condiment is dispensed along a travel path defined perpendicular to a longitudinal length of said applicator head; and, a conduit in fluid communication with said applicator head collar.

4. The condiment applicator of claim 3, further comprising:

a slow tip connected to said extension conduit, said slow tip comprising means for controlling a flow rate of the condiment, said flow rate controlling means being housed within said flow tip and including a restrictor tube having an inside diameter smaller than a diameter of said flow tip, said flow tip including a female collar in fluid communication with a conduit, said flow tip further including a male attachment axially opposed from said female collar.

5. The condiment applicator of claim 1, wherein said applicator head further comprises: a heat shield connected thereto.

6. The condiment applicator of claim 1, further comprising: a carrying case including a plurality of recessed compartments and an interior foam rubber padding lined within said recessed compartments.

7. The condiment applicator of claim 1, wherein said rotary plate is rotatably adaptable within said slot such that said first and second apertures become vertically aligned beneath said dispensing end of said applicator head collar.

* * * * *